United States Patent [19]

Wilson et al.

[11] 4,362,153

[45] Dec. 7, 1982

[54] BREATHING APPARATUS

[75] Inventors: John G. Wilson, Worsley; John Scott, Doncaster, both of England

[73] Assignee: Coal Industry (Patents) Limited, London, England

[21] Appl. No.: 204,109

[22] Filed: Nov. 5, 1980

[30] Foreign Application Priority Data

Nov. 27, 1979 [GB] United Kingdom ..... 7940867

[51] Int. Cl.[3] ..... A62B 7/00

[52] U.S. Cl. ..... 128/202.26; 128/205.12

[58] Field of Search ..... 128/202.26, 205.12, 128/205.13, 204.26, 204.28

[56] References Cited

U.S. PATENT DOCUMENTS

| | | | |
|---|---|---|---|
| 1,625,419 | 4/1927 | McCaa | 128/204.15 |
| 1,630,501 | 5/1927 | Steese | 128/205.12 |
| 2,088,164 | 7/1937 | Dym | 128/201.18 |
| 2,362,643 | 11/1944 | Lambertsen | 128/205.12 |
| 2,456,130 | 12/1948 | Lambertsen | 128/205.12 |
| 2,931,357 | 4/1960 | Arborelius et al. | 128/205.12 |
| 4,031,877 | 6/1977 | Botos et al. | 128/205.12 |
| 4,154,234 | 5/1979 | Baker | 128/205.12 |
| 4,186,735 | 2/1980 | Henneman et al. | 128/201.25 |

FOREIGN PATENT DOCUMENTS

| | | | |
|---|---|---|---|
| 1349411 | 12/1963 | France | 128/205.12 |
| 1539914 | 8/1968 | France | 128/205.12 |

*Primary Examiner*—Henry J. Recla

*Attorney, Agent, or Firm*—James C. Wray

[57] ABSTRACT

A breathing apparatus comprises a high pressure oxygen source, a reducing valve, set to give a constant flow rate of from 4 to 30 l/min of oxygen, personal gas supply means, with an inhalation valve and an exhalation valve, a regenerative section and a breathing bag. The apparatus provides a more comfortable and useful apparatus especially suited to the requirements of underground rescue in mines.

6 Claims, 1 Drawing Figure

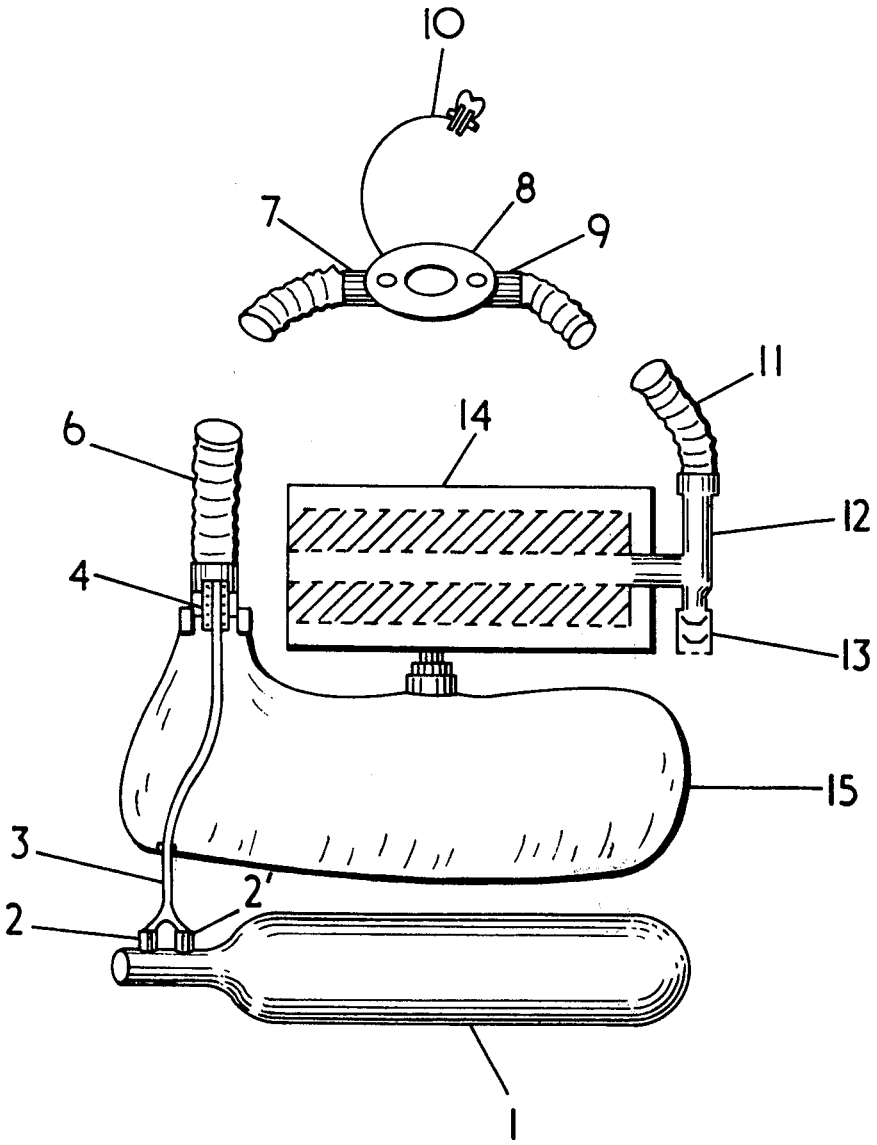
10
7
8
9
11
6
14
12
4
13
15
3
2'
2
1

BREATHING APPARATUS

This invention concerns breathing apparatus, more especially it concerns compressed oxygen breathing apparatus.

There are two types of compressed oxygen breathing apparatus in use in the British coal mining industry; one providing a constant flow of oxygen which can be supplemented when required by a manual by-pass valve, and the other, more modern apparatus, providing a lower constant flow in combination with a demand valve. It will be understood that only about 4% of the oxygen inhaled is used by the body and converted to carbon dioxide in the lungs. To conserve oxygen and to give the apparatus a long useful life for an underground rescue situation, the exhalations are purified in a regenerator containing a chemical absorbent and recycled, and the balance made up by a constant flow from a regulated oxygen cylinder of about $1\frac{1}{2}$–$2\frac{1}{2}$ l/min. This make-up flow of oxygen is sufficient to cater for most activity while wearing the apparatus and during most circumstances is in excess of what is required (during walking, for example), so that excess oxygen accumulates in the system inflating the breathing bag and increasing breathing resistance. A relief valve is provided on the breathing bag to vent excess oxygen. In cases where the breathing rate is abnormally high, for example if extreme efforts have to be made or in a very high stress situation, additional oxygen can be bled for short periods into the system by a manual self-return by-pass valve which by-passes the regulator on the cylinder. The alternative to the by-pass valve is a demand valve, actuated by the breathing requirements of the wearer.

The chemical absorbent, which may be either a caustic alkali or soda-lime, has certain unfortunate side-effects. Firstly, the chemical reaction involved is exothermic, with the result that the recycled oxygen is heated considerably by heat exchange as it passes through the absorbent. Breathing hot gas is exhausting, and therefore the apparatus normally requires a cooler on the inhalation side of the breathing circuit, through which the heated gas passes and gives up heat to a coolant which may be ice or a chemical such as disodium hydrogenphosphate dodecahydrate. An additional problem is that the gas breathed is normally fully saturated with water vapor.

It has always been realized that underground rescue work has a primary requirement for an extended useful life of breathing apparatus. This means that some form of closed circuit system is essential since an open circuit system, which vents exhalations to the atmosphere and thus requires no regenerative section, is extremely wasteful of air or oxygen. Open circuit breathing apparatus is used by fire brigades, where there is generally no need for lengthly rescue work of the type met with underground. Scuba divers also use open circuit apparatus; although the weight of full cylinder(s) for a $1\frac{1}{2}$–2 hour life is excessive on land it is no problem in water.

It is current and past practice throughout the world for mine rescue breathing apparatus to conserve oxygen. Previously, the most modern compressed oxygen breathing apparatus has had a combination of a relatively low constant flow of about $1\frac{1}{2}$l/min, that is sufficient for a "rest" or low work load situation and a demand valve which is actuated when the wearer requires extra "air". We have found that this system does indeed conserve oxygen but also retains heat within the system.

Furthermore, it is found that in a conventional closed circuit system, it is necessary to eliminate as far as practicable in-leakage during low pressure inhalation, or otherwise there is a risk of build-up of contaminant gases whether inerts such as nitrogen or toxics such as carbon monoxide, which are not eliminated by the purifier.

This modern apparatus is complicated, expensive, and what is of paramount importance in a mine rescue situation, requires lengthy and skilled servicing before re-use.

It is an aim of the present invention to provide an apparatus and method whereby breathing apparatus for use underground provides oxygen at a comfortable temperature, with humidity lower than in conventional closed circuit apparatus and which is capable of providing a useful life.

The present invention provides a breathing apparatus for use in an irrespirable atmosphere, that is to say, an atmosphere containing insufficient oxygen to sustain life and/or containing noxious components and at substantially ambient pressure which apparatus provides, in use, a high constant flow rate of oxygen, comprising a high pressure oxygen source, a reducing valve set to give a substantially constant flow rate of from 4 to 30 l/min of oxygen, personal gas supply means with an inhalation valve and an exhalation valve, a regenerative section and a breathing bag.

A preferred apparatus is a closed circuit apparatus having additionally a vent-to-atmosphere relief valve located between the exhalation valve and the regenerative section; the outward flow from the regenerative section being connected to the inhalation side of the personal gas supply means. A more preferred apparatus is one having the vent-to-atmosphere relief valve and arranged so that the exhalations from the deeper recesses of the lungs are vented to the atmosphere and do not pass through the regenerative section.

The invention also provides a method of providing oxygen to the wearer of a breathing apparatus which comprises supplying oxygen from a high pressure source to the wearer at a rate of from 4 to 30 l/min. Preferably, the initial part of each exhalation is recycled through a regenerative section containing a carbon dioxide absorbent, to the wearer and the latter part of each exhalation is vented to the atmosphere.

The high pressure oxygen source may be a tank, but is preferably a cylinder which is easily man-portable as part of the breathing apparatus. More preferably the source is a large capacity lightweight cylinder, for example a light alloy seamless steel cylinder. Such a cylinder for an oxygen supply is conveniently of 1500 l capacity at a charging pressure of 200 Bar. Of course, the apparatus may have more than one cylinder.

The reducing valve may be a piston type regulator known in the art. Conventional apparatus normally includes a by-pass valve in the event of failure of the reducing valve, and while a by-pass valve may form part of the apparatus of the invention, it is envisaged that two reducing valves in parallel would be provided. For example, each reducing valve may be set at 5 l/min, and in a light work or rest situation only one of the reducing valves would be necessary. The wearer will turn on the other reducing valve when he meets a high stress or high work situation. With two reducing valves in parallel, a by-pass valve is not essential.

The personal gas supply means may be conventional mouthpiece which would have inlet and outlet supply tubes as well as an associated nose-clip. Alternatively, a full face mask can be used which has the advantage that it can permit speech if fitted with a speech diaphragm or microphone. A full face mask does, however, suffer from the disadvantage of the risk of misting and loss of visibility, and this is accentuated by highly saturated oxygen supplies from closed-circuit systems. In addition, the wearer generally suffers facial sweating, especially on the forehead. Many methods have been used in attempts to reduce the misting but none has proved to be entirely satisfactory with closed circuit apparatus. Modern full face masks may have an inflatable seal around the head contacting edge, which is intended to reduce the change of leakage of contaminants from the atmosphere into the mask. It is found, however, that the seal may not be effective with abnormally shaped heads, and is seriously disturbed if the wearer has more than about three days' growth of beard or attempts to wear spectacles. It is envisaged that the present invention can be used with a full face mask with at least a part of the fresh oxygen from the cylinder or tank piped directly into the space between an orinasal half mask and an outer full mask. This will reduce the tendency for inleakage, reduce the misting problem an also reduce the problems associated with facial sweating, especially if the fresh oxygen is directed onto the wearer's face.

The vent-to-atmosphere valve is suitably a simple pressure relief valve, preferably with the facility for manual override.

As has been stated, the vent-to-atmosphere valve is between the exhalation valve and the regenerative section. Preferably, the regenerative section is a radial flow type, in which the exhalations pass into a central core(s) and permeate outwards through a hollow cylinder(s) filled with absorbent. It has been found that with this position of the vent-to-atmosphere valve, the initial part of each exhalation, from the upper trachea and bronchial tubes, passes into the regenerative section and as it permeates through the absorbent, a back pressure builds up so that the vent-to-atmosphere valve actuates, venting the latter part of each exhalation to the atmosphere. The latter part of each exhalation is from the deeper recesses of the lungs and is fully saturated with water vapour and has the highest concentration of $CO_2$. The consequences of this will be discussed below.

The breathing bag and regenerative section are conventional and in principle well known in the art.

Preferably, the apparatus is constructed to run cool. For example, the breathing bag may be in thermal contact with the cylinder, which is cooled by adiabatic expansion of the compressed gas. Similarly the breathing bag is preferably insulated from the regenerative section which is warmed by the heat of reaction.

A number of advantages follow from the apparatus and method of the invention. It will be instantly recognized that the invention runs counter to all progress in closed circuit breathing apparatus made over the last decades. A constant supply of oxygen is provided which is greatly in excess of that required and of that previously supplied by high pressure constant flow breathing apparatus. The use of a high pressure supply and a flow rate which in preferred apparatus is of the order of 10 l/min brings several advantages, primarily in convenience and comfort for the wearer. The apparatus in its preferred embodiments provides oxygen at a temperature in all except possibly the most severe conditions at a comfortable temperature. This is believed to follow from a number of different effects: firstly, there is adiabatic cooling of the compressed gas as it leaves the high pressure source; secondly, since a relatively large amount of gas is vented to the atmosphere this carries body heat with it; thirdly, because the latter part of each exhalation comes from the deeper recesses of the lungs and is vented to the atmosphere this latter part is warmed to body temperature and also contains the highest concentrations of $CO_2$, which if passed through the regenerative section would generate appreciable heat. In addition, and especially when a full face mask is used, the large flow of gas itself produces a physiological cooling effect on the wearer.

In the case of a high humidity and/or high temperature environment, the wearer is subject to adverse effects. It is more than usually desirable to provide relatively cool and dry air to the wearer. The apparatus of the invention may be adapted for extremes in high temperature and humidity by increasing the constant flow rate up to 30 l/min with a corresponding reduced effective duration; alternatively, use may be made of a cooler, such as an ice cooler, a drier, such as silica gel, or a cool suit as an ice-filled suit. The apparatus of the invention may include for such difficult conditions one or more of the following: a cooler, such as an ice cooler, a drier, such as one containing silica gel; and an exhanced flow rate, for example of 20 to 25 l/min.

As well as being relatively cool, the gas breathed is drier than with conventional compressed oxygen closed circuit apparatus because of the loss of body moisture in exhalations is not permitted to build up and is vented to the atmosphere, and there is additionally a high input of fresh oxygen.

The apparatus of the invention may be split, with some components carried on the front of the body and some on the back, but is preferably carried in a compact pack on the back. Preferably a smooth outer cover is provided to minimize snagging whilst crawling.

It is envisaged that the apparatus may be constructed so as to provide for the resuscitation of persons found unconscious in an irrespirable atmosphere.

The apparatus of the invention is comparatively simple, and therefore can be expected to be more reliable and easier and quicker to service than the most modern breathing apparatus currently available. Reliability and ease of servicing is a major consideration at the time of a major incident when a rapid turn-round of apparatus is required. The alternative is the requirement of excessively large stocks of apparatus, which also necessitates a heavy servicing and testing load to maintain the stock in good order. The apparatus of the invention does not require the careful purging before use which is essential with most conventional closed circuit compressed oxygen apparatus, and also because of its inherent flexibility and comfort can be used by untrained men and also older or less fit men.

Exhaustive wearer trials of an apparatus according to the invention have shown a much improved degree of wearer comfort after work, compared to control trials with conventional apparatus.

The invention will now be described by way of example, with reference to the accompanying drawing, which is a schematic diagram of a breathing apparatus according to the invention.

Mounted on a support sheet or frame (not shown) which support sheet or frame has conventional shoulder straps, is a lightweight high capacity cylinder, 1, of oxygen. The cylinder feeds through two constant flow reducing valves, 2, 2'; valve 2 set to give 5 l/min of oxygen through feed pipe, 3, which can be augmented by the second reducing valve 2' which is pre-set to a convenient level according to the environment requirements, at from 4 to 25 l/min, for example also 5 l/min. The feed pipe 3 supplies fresh oxygen as near as practicable to the inhalation side of the mouthpiece (8) and is shown terminating adjacent the outlet of a breathing bag, 15 and held within a perforated frusto-conical diffuser, 4. Mounted at the outlet of the bag is an inlet breathing tube, 6. The tube 6 is connected by means of inhalation valve, 7, to a conventional mouthpiece, 8, and an outlet breathing tube 11, is connected thereto by an exhalation valve, 8. Attached by a cord to the mouthpiece, is a noseclip, 10. The tube 11 feeds into a manifold 12 fitted with an automatic relief valve 13 and an inlet into a radial flow regenerative section or purifier, 14. The purifier is charged with an absorbent such as soda lime. The purifier is connected to breathing bag 15.

In use, a primary constant flow of 5 l/min of oxygen, augmented if required by a secondary flow of 5 l/min, issues from the end of pipe 3. During inhalation, valve 7 opens, and the fresh oxygen from pipe 3 feeds into the breathing tube 6, drawing with it oxygen from the breathing bag 15. The wearer has, of course, the mouthpiece 8, in his mouth and is wearing noseclip 10. When the wearer exhales, valve 9 opens and valve 7 closes, so that oxygen from pipe 3 passes into the breathing bag. The wearer's exhalation passes through breathing tube 11 and begins to pass through the purifier 14. As the back pressure builds up, valve 13 opens to vent the exhalation from the deeper recesses of the lungs to the atmosphere. The part of the exhalation which permeates through the soda-lime in the purifier has its $CO_2$ content absorbed therein and the remainder, that is purified oxygen, passes into the breathing bag, wherein it mixes with the cool dry fresh oxygen from the cylinder.

We claim:

1. A method of reducing heat generated in a breathing apparatus used in an irrespirable atmosphere comprising a high pressure oxygen source provided with reducing valve means presettable to give a continuous high sustained constant flow rate of oxygen from the source in the range of 4 to 30 l/min, personal gas supply means to which the flow of oxygen is supplied, said gas supply means having an inhalation section with an inhalation valve and an exhalation section with an exhalation valve, a regenerative section connected to the exhalation section for absorbing carbon dioxide from exhaled air and a breathing bag connected to the regenerative section so that exhalations which have passed through the regenerative section flow into said bag, the bag having a connection to the inhalation section, and means for exhausting excess gas from the breathing circuit; said method comprising releasing oxygen from the high pressure source through the reducing valve means pre-set to give a continuous high sustained constant flow rate of oxygen in the range of about 4 to 30 l/min, communicating said continuous high sustained constant flow rate of oxygen to the inhalation section of personal gas supply means which supplies breathable gas to a wearer, communicating exhaled air from the exhalation section of the personal gas supply means to the regenerative means for absorbing carbon dioxide from said exhaled air, communicating carbon dioxide-free air from the regenerative means to the breathing bag, communicating air from the breathing bag to the inhalation section of the personal gas supply means, and exhausting excess gas through said exhausting means to the atmosphere whereby heat, moisture and carbon dioxide produced by the wearer, which would otherwise increase the heat generated inside the regenerative section, is carried by said high sustained flow of oxygen through said apparatus and exhausted to atmosphere.

2. The method of claim 1 wherein the exhausting step comprises exhausting excess air communicated from the exhalation section of the personal gas supply means.

3. The method of claim 1 wherein the exhausting step comprises exhausting exhaled air from the deeper recesses of the wearer's lungs.

4. The method of claim 1 wherein the releasing step comprises releasing oxygen through a primary reducing valve at a flow rate of about 5 l/min and selectively releasing oxygen through a second reducing valve at a flow rate of about 4 to about 25 l/min.

5. The method of claim 1 further comprising communicating oxygen from the source to the breathing bag.

6. The method of claim 1 wherein the exhausting step comprises building up back pressure in the regenerative means, opening an exhaust valve when the back pressure reaches a predetermined level, exhausting exhaled air through the opened exhaust valve.

* * * * *